United States Patent [19]

Taillet et al.

[11] 4,435,190

[45] Mar. 6, 1984

[54] METHOD FOR SEPARATING PARTICLES IN SUSPENSION IN A GAS

[75] Inventors: Joseph Taillet, Boulogne; Serge Larigaldie, Chatenay Malabry, both of France

[73] Assignee: Office National d'Etudes et de Recherches Aerospatiales, France

[21] Appl. No.: 266,587

[22] Filed: May 22, 1981

[30] Foreign Application Priority Data

Mar. 14, 1981 [FR] France ..... 81 09646

[51] Int. Cl.[3] ..... B03C 3/00

[52] U.S. Cl. ..... 55/5; 55/107; 55/126; 55/135; 55/131; 55/479; 361/225; 361/230; 239/3; 239/690

[58] Field of Search ..... 55/150–153, 55/136–138, 133, 479, 131, 5, 8, 107, 126; 361/225–235; 239/3, 690, 706; 62/347, 74

[56] References Cited

U.S. PATENT DOCUMENTS

| | | | |
|---|---|---|---|
| 3,400,513 | 9/1968 | Boll | 55/138 |
| 3,568,404 | 3/1971 | Walker | 55/5 |
| 3,612,923 | 10/1971 | Collier et al. | 55/5 |
| 3,757,491 | 9/1973 | Gourdine | 361/230 |
| 3,768,258 | 10/1973 | Smith et al. . | |
| 3,826,063 | 7/1974 | Festner . | |
| 4,029,482 | 6/1975 | Postma et al. | 55/131 |
| 4,144,359 | 3/1979 | Zahedi et al. | 55/131 |
| 4,339,782 | 7/1982 | Yu et al. | 55/131 |

FOREIGN PATENT DOCUMENTS

| | | | |
|---|---|---|---|
| 833799 | 3/1952 | Fed. Rep. of Germany . | |
| 2349364 | 11/1977 | France . | |
| 2383707 | 10/1978 | France . | |
| 55-104621 | 8/1980 | Japan | 55/131 |

OTHER PUBLICATIONS

International Search Report FA 253 766, Jan. 28, 1981.

*Primary Examiner*—Bernard Nozick
*Attorney, Agent, or Firm*—Kane, Dalsimer, Kane, Sullivan and Kurucz

[57] ABSTRACT

A gas carrying solid particles is purified by electrically charging the solid particles and precipitating them by electrostatic means. The particles carrying gas flows in an enclosure wherein a space charge is formed by ion generators. Each ion generator comprises an injector tube which defines a chamber communicating with the enclosure via a small opening. Moist air is fed under pressure in the chamber and is accelerated in a tuyere in this opening. A corona discharge is formed at the neck of the tuyere by applying a high voltage between the tuyere and a coaxially arranged needle like electrode. Microparticles of ice are formed in the corona discharge zone by reason of the supersonic gas discharge in the tuyere. Ions trapped by these microparticles are driven out of the ion generators chamber into the enclosure wherein the gas stream to purify flows. These ions are freed by evaporation of the ice microparticles to form the space charge. The method is particularly suitable for purifying explosive atmospheres or hot gases.

5 Claims, 12 Drawing Figures

METHOD FOR SEPARATING PARTICLES IN SUSPENSION IN A GAS

FIELD OF THE INVENTION

The present invention relates to the de-dusting of a gaseous atmosphere.

In particular, its object is to obtain the separation of solid particles in suspsension in a gas by circulating the gas in an enclosure where they are retained by an electrostatic effect.

BACKGROUND OF THE INVENTION

The electrostatic de-dusting methods are based on the attraction exerted on electrically charged dust particles by one or several electrodes brought to a potential of charge opposite to that of the dust particles.

Thus, electrostatic de-dusting installations comprise means for circulating in an enclosure a gaseous fluid loaded with dust particles, a device adapted for electrically charging said dust particles and one or several electrodes adapted for attracting said dust particles.

According to a known technique, the dust particles contained in the gas stream to be purified are electrically charged by producing a corona electric discharge in said gas. To this effect, the gas is made to flow in the interval between a first electrode, made of a conductive pin or of a stretched conductive wire, and a second electrode having a relatively large surface, plane or cylindrical for example, and a potential difference of the order of several tens of kilovolts is applied between said electrodes.

The electrical field in the vicinity of the first electrode, which is very strong, causes the formation in a very small region, called active region, of electronic avalanches which generate a large quantity of ions and electrons. The electrons, which are very mobile, tend to leave rapidly the active region by causing at the edge of said active region the formation of a high concentration of positive or negative ions according to whether the first electrode is positive or negative relative to the second electrode. This ion concentration forms a space charge. The dust particles moving within the space charge region acquire by diffusion or bombardment a charge of same sign as the space charge. The final charge of each dust particle is depending on its size, its time of residence in said region and on the value of the space charge, measured by the product of the quantity of ionized particles per unit volume in the space considered and the charge of said particles.

In the case where the dust particle loaded gas is explosive, such as the atmosphere of a wheat silo where the very fine gluten dust which accumulates in the ambient air provides a very explosive mixture, the creation of a corona discharge is to be prohibited, the smallest spark being potentially the origin of considerable damage.

On the other hand, the efficiency of a corona discharge decreases with increases in the gas temperature in which it is produced. This is due to the thermal agitation of the gaseous fluid molecules. When one of said molecules collides with a negative ion, it causes the detachment of the electron from the latter, which produces an increase of the electronic current of the discharge, with a consequent drop of efficiency of the production of the space charge and the appearance of instabilities in the discharge.

This is why the de-dusting of combustion gases issued from hearths, for example fluidized bed hearths burning coal or reclaimed fuels having a low heat value, by using a corona discharge is practically impossible. For lack of an efficient de-dusting method, it has not been possible hitherto to associate directly such hearths to piston engines or gas turbines without these being rapidly deteriorated by the action of the dust particles.

Electrostatic precipitation de-dusting techniques are also known, where there is no corona discharge but an association of very fine droplets with the dust particles one wishes to eliminate.

Thus, for example, it has been proposed to purify a gaseous stream through a gas-liquid contact by spraying a liquid in a supersonic nozzle fed with compressed air, the resultant atomizate being injected, generally against the current, in a gaseous fluid stream to be purified. The nozzle is brought to a high electric potential relative to the mass of the installation, so that the water droplets coming out from it are charged and stick to the dust particles so as to drive them towards the metallic parts electrically connected to the mass of the installation, thereby providing their separation from the gas. The residual dust particles which are carried with the droplets in the gas stream beyond the nozzles are in turn precipitated on an electrode brought to a convenient electric potential.

A further known technique of said type consists in producing a jet of fine water droplets at the outlet of a nozzle connected to the mass and placed opposite an annular electrode polarized by a high voltage so as to impart to said water droplets a charge of predetermined sign. When the particles to remove from the atmosphere receiving the jet are themselves already electrically charged, the charged water droplets are attracted by said particles and form a mist causing their deposition.

Both of these techniques implement a washing with water of the gas to be purified and therefore do not allow a dry treatment of the gas or any atmosphere where the formation of slurries is to be prohibited. Moreover, they are inefficient as regards atmospheres at temperatures at which the water droplets are vaporized before associating themselves to the particles to be removed.

OBJECTS AND SUMMARY OF THE INVENTION

The present invention relates in particular to an improved separation method of solid or dust particles in suspension in a gas by electrostatic precipitation, and which, in particular, allows solving the previously mentioned problems of the de-dusting of explosive or high temperature atmospheres.

A method for the electrostatic separation of particles according to the invention is characterized in that a corona discharge is produced in a chamber distinct from the enclosure in which flow the gases to be de-dusted, ions produced in said chamber are trapped by aerosol microparticles which are injected into the enclosure where the trapped ions are freed by the change of state of said particles, for example by sublimation, thereby generating therein a space charge. Thus, the aerosol particles play the part of charge vectors between said chamber and the circulation enclosure for the gases to be de-dusted.

According to an embodiment, said aerosol microparticles are ice microparticles obtained by supersonic expansion of the moisture loaded compressed air in the region of the corona discharge. The microscopic ice crystals evaporate or sublimate within the enclosure when in contact with the gas to be purified and free the ions which they carry for forming the space charge therein.

This method produces electric charges in a first medium contained in said chamber and they are transferred to a second medium contained in said enclosure where flows the gas to be purified, for creating therein a space charge. The first and second medium are electrically independent, so that no spark of the first medium can propagate to the second medium. Moreover, the characteristics of the first medium where the ion formations are generated are not influenced by those of the second medium where said ions are used for charging particles to be precipitated electrostatically. It is contemplated to maintain the space charge on the path of the gas to be purified at a value largely lower than that which should be sufficient for starting a corona discharge at some point of the corresponding enclosure. Thus are completely eliminated the discharge or spark hazards where the atmosphere to be purified is explosive.

It has been established that values of the space charges which are sufficiently low for not being dangerous are quite efficient for charging electrostatically the particles for their precipitation.

Moreover, according to an aspect of the invention, there is provided for such atmospheres to use in the first chamber a negative corona discharge. Thus is obtained a good energetic efficiency and a stable negative ions transfer on the path of the fluid stream to be purified.

Where the atmosphere to be purified is at a high temperature, the method according to the invention provides for maintaining a corona discharge in a chamber the temperature of which is sufficiently low for obtaining a good efficiency for the generation of the space charge and, from said chamber, to transfer the ions in the hot gases to be purified. It is advantageously provided to inject positive ions produced from a positive corona discharge. Thus is avoided the presence in the second chamber of electrons generated by collisions of negative ions with the gas molecules energized by the thermal agitation. It is also contemplated to adjust the space charge so as to limit the likelihood of electrons being produced by ionization in the hot gas volume to be de-dusted. This adjustment can be carried out by acting on the potential of the point around which is produced the corona effect in the first chamber, thereby varying the current transported by the mircoparticles in the second chamber.

A further object of the invention is an electrostatic separator of the type comprising an enclosure wherein flows a gaseous stream driving particles in suspension, means comprising a ion generator by corona effect for electrically charging said particles, and means on the path of said gaseous stream for electrostatically precipitating said charged particles, wherein said ion generator comprises means for defining a chamber distinct from said enclosure and communicating via an opening with the latter, means for producing corona discharge in a gas stream circulating in said chamber towards said opening, and means for causing the formation, in the corona discharge region, of aerosol microparticles, adapted for trapping ions before being injected through said opening into said enclosure.

BRIEF DESCRIPTION OF THE DRAWINGS

The following description which is given by way of example refers to the accompanying drawings wherein.

Figure 1:
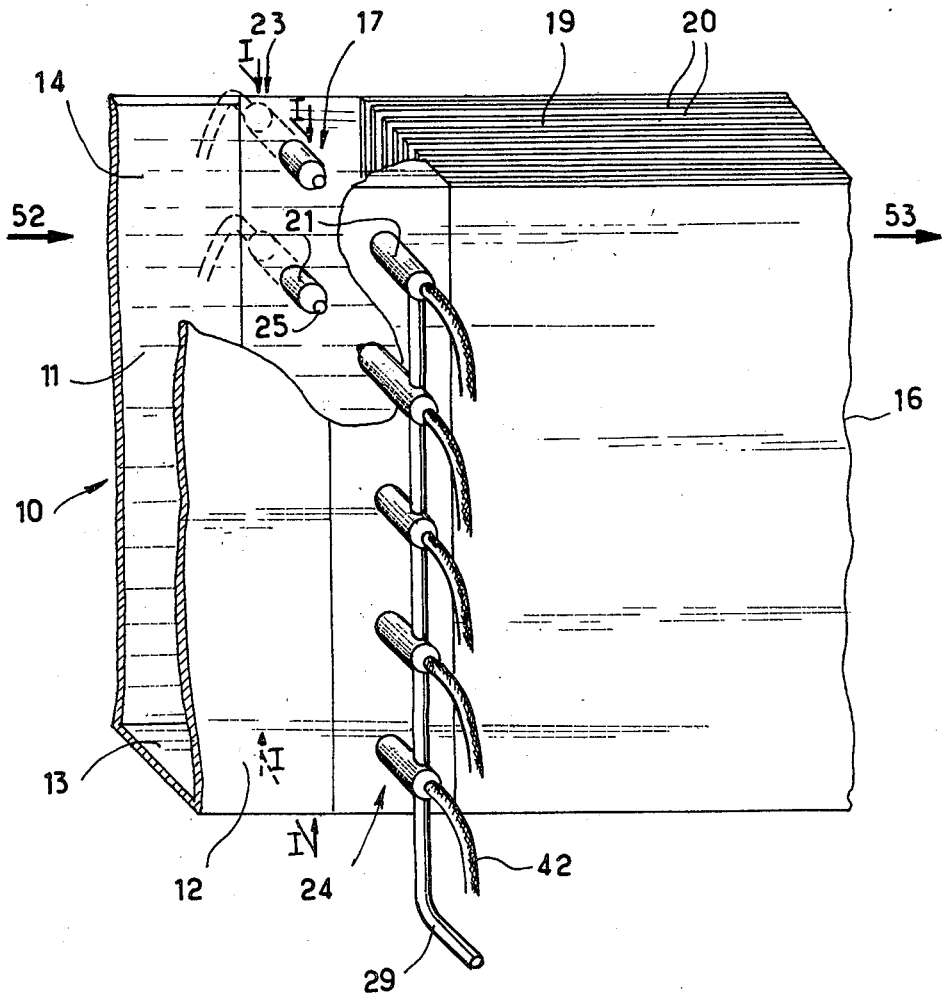
FIG. 1 is a perspective schematic representation, partly broken away, of an installation according to the invention.

An enclosure is made of a parrallelepipedal passage 10 (FIG. 1) bounded by two parallel vertical walls 11 and 12, a floor 13 and an upper wall 15 (not shown in FIG. 1). The enclosure 10 is formed with an inlet opening 14 for the gas to be purified and an outlet 16 for its discharge after precipitation of the solid particles contained in said gas. The inlet 14 opens into a charge region 17 followed, along the path of the gas to be purified in the enclosure 10, by an electrostatic precipitation region 19 comprising a plurality of plates 20 parallel to walls 11 and 12, alternately connected to potential sources respectively positive and negative.

In the charge region 17 emerge a plurality of injectors 21 aligned according to vertical rows 23 and 24, the injectors of row 23 extending though wall 11 and the injectors of row 24 extending through wall 12.

Figure 2B:
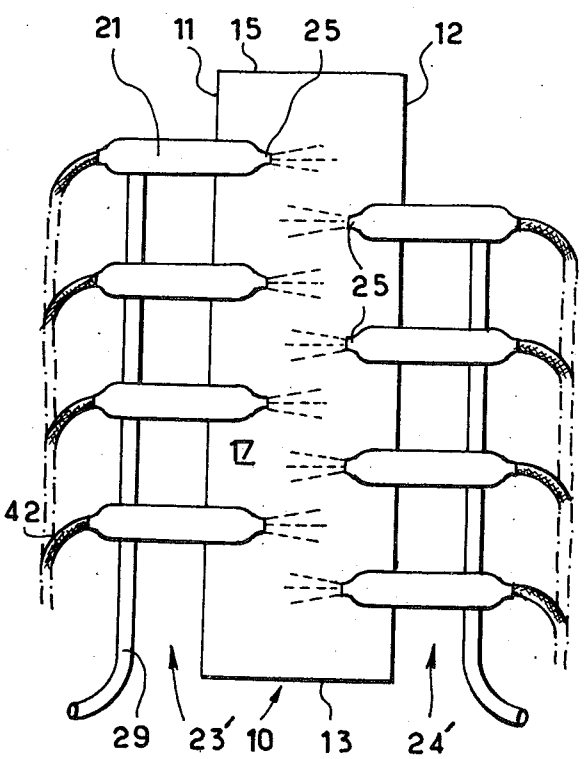
FIGS. 2*a* and 2*b* show two alternative embodiments for the mounting of the injectors in the installation, seen in cross-section in plane I—I of FIG. 1.
Figure 2A:
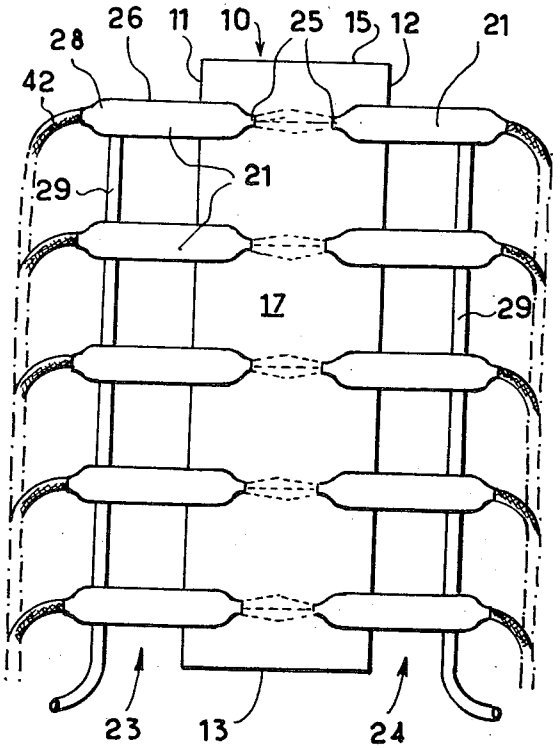

Each injector comprises at its front end a nozzle 25 (FIGS. 2*a* and 2*b*) opening into passage 10, a body 26 extending through wall 11 or 12, respectively perpendicular to the latter and a rear end 28 connected on the one hand to a common duct 29 for the admission of compressed moist air and on the other hand to a high voltage supply cable 42 (FIG. 2*a*).

Injectors 21 of FIG. 2*a*, which are five in number in each row 23 and 24, are mounted in the walls 11 and 12 so that the nozzle 25 of each injector of row 23 is placed opposite a nozzle 25 of a homologous injector of row 24.

The injectors of FIG. 2*b* are staggered, the other injectors extending across wall 12 forming a row 24' of injectors the axes of which are off-set relative to the axes of the four injectors of row 23' in wall 11.

Each injector 21 (FIG. 3) comprises a tubular body 30, conductive or insulating, bounding an inner cylindrical chamber 32. A tuyère 34, defining a neck 35, is mounted in front of tube 30 in the axis of the latter. The diverging portion of the tuyère opens into a tubular nipple 36 forming the injection nozzle 25. The rear portion 28 of the tube 30 extends into a hollow cylinder 38 closed at its rear portion and formed with a side opening 39 connected to the compressed air supply duct 29. The rear wall 40 of the hollow cylinder 38 comprises a tight insulated lead-through 41 to which is connected electrical feeding cable 42; the lead-through is connected to a first tapered electrode or needle 45 fixed by a mounting 44 on the inner wall of tube 30. The mounting 44 is insulating, made of a star structure comprising for example three radial legs. The needle 45 is metallic and placed in the axis of tube 30, its point ending at the level of neck 35 of tuyere 34. Said tuyère is made of an electricity conductive material and forms a second electrode connected to a continuous voltage source 48 via cable 49 and to the mass of the installation via a connection 51. The needle 45 is connected through conductor 42 to the other pole of the high voltage source 48.

In operation, when the voltage reaches a value which is sufficiently high, a corona discharge is established between the needle 45 and the tuyère 34 in the moist gas crossing the neck 35 of the latter.

If the central electrode or needle 45 is negative, it collects the positive ions and the electrons diffuse away. In the gaseous fluid where the discharge is produced, the electrons quickly fix themselves to the molecules of the electronegative gases by generating negative ions less mobile than said electrons, which form a space charge. It can be demonstrated that the electric energy efficiency of the formation of a negative space charge is improved all the more that the gas which is the seat of the discharge promotes the formation of negative ions. The poor mobility of the negative ions allows moreover obtaining a stable space charge around the central electrode 45. Such is the case with dry or moist air. With poorly electronegative gases, there is a possibility of instabilty phenomena which occur when the electrons, which do not tie themselves to the negative ions, generate ionized filaments across the gas, when degenerate into electric arcs capable of causing the short-circuit of the central electrode, and consequently to have an unfavourable effect on the operation of the device.

If the central electrode 45 is positive, the electrons progress rapidly towards said electrode, by leaving a very high quantity of ions which form a sufficiently dense plasma for causing the formation of a ionized channel appearing as a starting spark. The channel progresses from the central electrode in the direction of the second electrode by pushing forward the active region, which is the seat of the avalanches. If the ionized channel progresses up to the second electrode, there is a short-circuit between said two electrodes. By limiting the potential difference applied across the electrodes, it is possible to limit the progress of the active region so that the discharge is maintained without starting a spark and producing a dangerous short-circuit, the active region being surrounded by a space charge made of positive ions.

The air admitted in duct 30 has a medium hygrometric degree, for example 50% relative humidity under the normal pressure and temperature conditions. In this respect, the freedom available is rather large and any air the hygrometric degreee of which is over 10% is acceptable for implementing the method, thereby allowing carrying it out without particular measures for the humidification of the ambient air in varied locations. Where the air is too dry, one starts by compressing it to the generating pressure necessary for obtaining the supersonic expansion, then the air is wetted by being passed in a humidificator before being admitted into duct 30.

Figure 4:
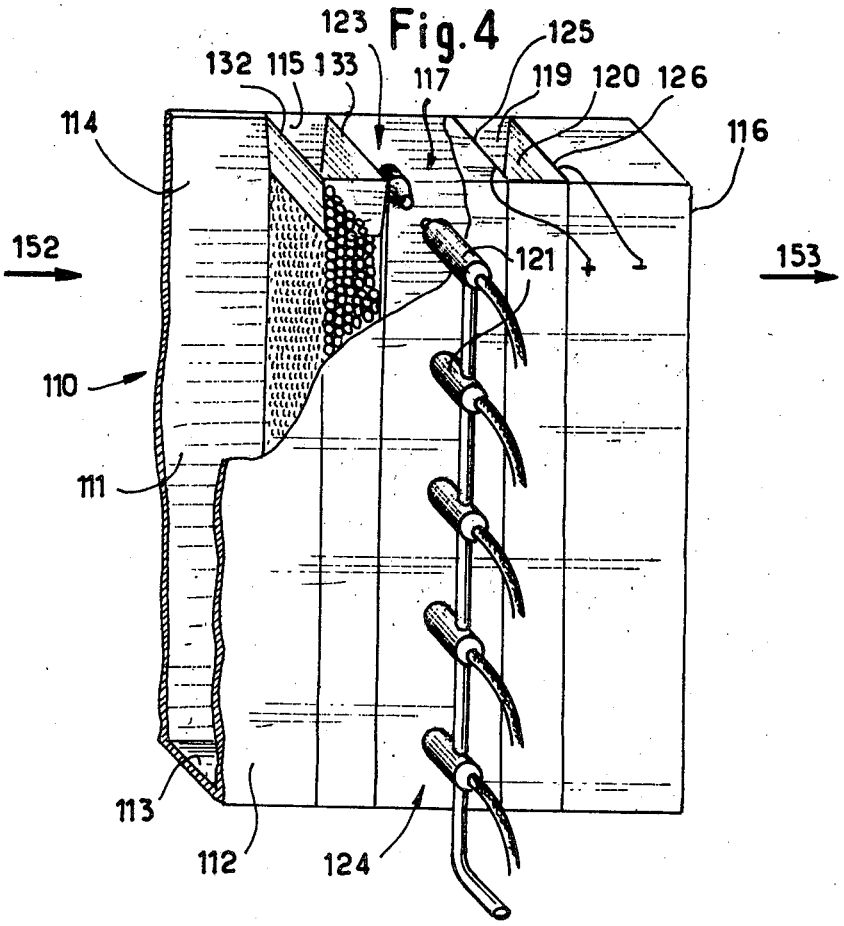
FIG. 4 is a sectional view, partly broken away, of an embodiment for de-dusting hot gases.

The supersonic expansion of the moist air in the diverging portion following neck 35 in FIG. 4 produces ice microparticules having a diameter of the order of a hundredth of a micron which "trap" the ions generated by the corona discharge entertained by the high potential difference existing between the point of needle 45 and said tuyère body 34. The jet of microparticules at the outlet of the tuyere drives away the charges trapped inside nozzle 25 towards the charge region 17 within enclosure 10. Said charges are freed by vaporization of the ice microcrystals at 10 odd centimeters from tuyere 34. They spray then by diffusion and under the effect of their own space charge in region 17 before being collected by the metallic walls 11, 12, 13 and 15.

The value of the space charge thus created can be controlled by acting on the formation parameters of the corona discharge, and in particular the potential difference applied between the electrodes, the air speed and pressure, the size of the tuyere causing the compressed air expansion, etc.

The value of said space charge can be relatively low, with respect to that used for the corona discharge inside injector 21, while providing a sufficient ionic density in space 17 for charging the dust particles carried in a gas stream at a level allowing their subsequent precipitation in the electrostatic precipitation region 19.

The electric current transported by the charged particles in the charge region 17 is relatively low with respect to the current injected by injector 21. The major portion of said current moves then, in the form of an ion current, to the metallic wall of the charge enclosure 17 which is connected to the mass in parallel with the body of tuyère 34 and plays a part similar to the extra electrode of standard corona discharge de-dusters.

A gaseous fluid which is loaded with dust is admitted at inlet 11 of enclosure 10 in the direction of arrow 52 (FIG. 1) and crosses the charge region 17 where the dust particles are charged by diffusion and bombardment when in contact with the space charge, so that they are then precipitated on the polarized plates 20 of the electrostatic precipitation region 19 during their passage between them; the purified gas leaves enclosure 10 in the direction of arrow 53.

In an embodiment, the needle 45 is brought to a negative potential of 12 kilovolts relative to the tuyere and a 50 micro-amperes current is produced at the outlet of said tuyère when the duct 29 feeds the injector at the flow of 20 $m^3$/hour of moist air (measured under the normal temperature and pressure conditions) under a generating pressure of 6 bars, from which results a supersonic expansion at a Mach number in the vicinity of 1.5 in neck 35 of tuyère 34, having a diameter of 2.3. mm.

The enclosure 10 has a height of about 100 cm and a width of 40 cm. The charge region has an effective length of 20 cm and the injectors are placed face to face in said region, their nozzles being spaced apart by 30 cm. Each couple of injectors, face to face, lets through a total current of 100 micro-amperes which, with the considered geometry and taking in account the mobility of the ions, allows creating a space charge in region 17 of $10^{13}$ positive or negative ions/$m^3$ at the minimum, corresponding to an electric field of $1.7\times10^5$ volts/meter.

The gas admitted, previously mechanically purified, carries at a speed of 2 m/s a flux of residual dust particles with a flow rate of 7 g/second, the average diameter of said dust particles being of 3 microns. Each dust particle crosses the charge region in 0.1 second, acquiring about 300 negative charges in the average, corresponding to a charge current of 12 micro-amperes from the injectors.

The flux of charged dust particles penetrates the precipitation region 19 the dimensions of which are the following: height 100 cm, length 100 cm, distance between plates 2.60 cm, said plates being connected to alternately positive and negative potentials of 10 kilovolts.

The driving speed of the gaseous fluid carrying the charged dust particles is of 2.8 m/s in this region, and the duration of the passage between the plates is of 0.35 sec for obtaining an almost total precipitation of said particles.

The embodiment shown in FIG. 4 is a gas de-duster comprising an enclosure 110 bounded by walls 111, 112, 113, similar to walls 11, 12, 13 of the enclosure of FIG. 1, and, in the order, between its inlet 114 and its outlet 116, a first filtration granular bed 115, to which is imparted a slow downward movement, and a charge region 117 into which open a series of injectors 121 forming vertical rows 123 and 124 extending respectively through walls 111 and 112. Injectors 121 are similar to those of FIGS. 1 to 3. Following region 117 is a second filter 119 comprising a vertical granular bed to which is imparted a slow downward movement, filling the space between two metallic hollowed or grid plates 125 and 126, transverse relative to walls 111 and 112, and respectively connected to the positive and negative terminals of a continuous high voltage supply, or to two terminals of an alternating supply, for carrying out the electrostatic precipitation of the particles of the gaseous stream issued from chamber 117 on the filter grains charged by influence.

The gas to be de-dusted reaches in the direction of arrow 152 the inlet 114. The purified gas is delivered in the direction of arrow 153 at outlet 116. This separator is different to the previous one by its reduced volume.

The two described separators are applicable to the de-dusting of gases loaded with very insulating dust particles for which the known apparatus are inefficient.

Figure 6:
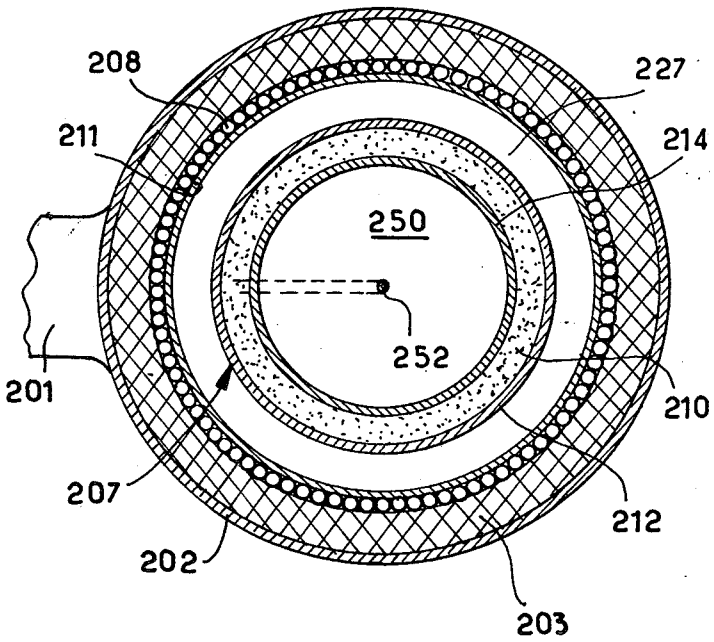
FIG. 6 is a transverse sectional view in plane VI—VI of FIG. 5.
Figure 5:
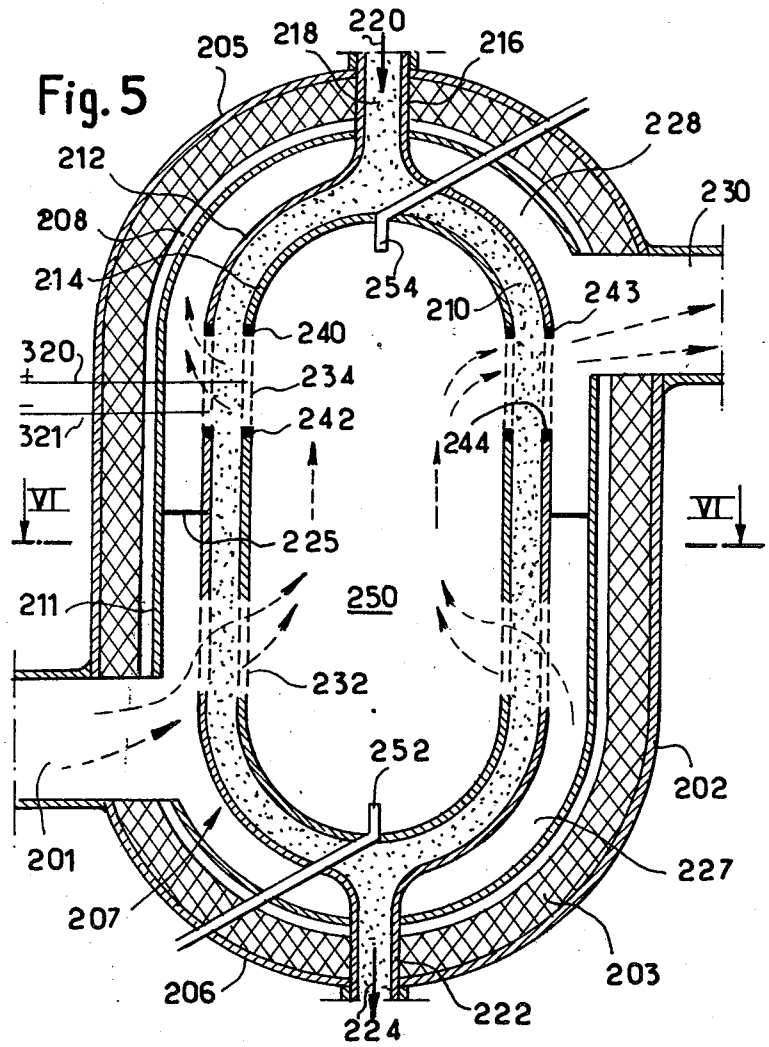
FIG. 5 is a vertical cross-sectional schematic view of another embodiment of a hot gases purifying installation.

The de-duster of FIGS. 5 and 6 receives gases to be dedusted at the pressure of 12 bars and at 900° C., such as those from the combustion of poor coal or combustible refuse in a hearth fed according to the fluidized bed technique with dry ashes under pressure.

This de-duster for hot gases comprises filtration elements of general cylindrical shape and the circulation of the gases is designed in view to minimize the heat losses of said gases between in the inlet and the outlet of the de-duster. Said gases are issued from a fluidized bed hearth which is fed with previously heated oxidant air.

The gases to be de-dusted are admitted under pressure by a piping 201 into a tank 202, comprising inside a heat-insulating layer 203, and of general vertical cylindrical configuration presenting at its upper and lower ends two hemispherical domes, respectively 205 and 206. Between the heat-insulating layer 203 and a metallic wall 211 are provided a series of ventilation channels 208 adapted for circulating fresh air, before its admission as comburent in the hot gases generating hearth, with a view to heating it. Inside the space limited by the heating channel 208 is housed a granular bed filter 207 having a shape substantially geometrically similar to that of tank 202 relative to its centre. Said filter comprises an outer wall 212 and an inner wall 214 between which is provided a space filled with balls of alumina, of small size (diameter 2 mm) forming a granular bed 210. The wall 212 is formed with an opening at its upper portion, connected by a tubing 216 extending through the upper dome 205 of the pressure tank 202 so as to admit granulates 218 circulating in space 210 in the direction of arrow 220. At its other end, the wall 212 comprising an outlet tubing 22 extending through the lower dome 206 of tank 202 so as to allow the removal of the granulates of the filtration bed 110 in the direction of arrow 224. The granulate mass filling the space between walls 212 and 214 flows very slowly, for example at the speed of 1 m/hour, from the top to the bottom.

The space between the metallic wall 211 separating the air reheating channels 208 from the inside of the tank and the wall 212 is divided by a transverse annular wall 225 at mid-height into two chambers, a lower one 227 into which opens the hot gas inlet 201, and a upper one 228 being connected to an outlet 230 for the purified gas.

The walls 212 and 214 comprise annular sieves capable of retaining the alumina balls of bed 210 for forming two annular filtration regions through which can flow the gas to be purified, one at 232 between chamber 227 and chamber 250 bounded by wall 214, and the other at 234, between chamber 250 and chamber 228. Thus, the hot gases penetrating by inlet 201 are subjected to a first mechanical purification when crossing region 232 of the granular bed, at the lower portion of tank 202, and to a second purification when flowing back through the granular bed in region 234 in the direction of the outlet 230.

This second passage is accompanied with an electrostatic precipitation of the particles. As a matter of fact, two insulating rings, an upper one 240 and a lower one 242, separate the sieve region from the rest of the inner wall 214 and two similar insulating rings, an upper one 243 and a lower one 244, separate the sieve region from the rest of the outer wall 212 of filter 207. The sieve insulated from wall 214 in the filter region 234 is connected to a positive pole 320 of a continuous high voltage source while the opposite annular sieve of wall 212 is connected to a negative pole 321 of said voltage source which is not shown, so as to charge by influence the alumina balls disposed in region 234. As an alternative, it is possible to subject the sieves to an alternating high voltage.

The inside of chamber 250 bounded by the inner wall 214 forms a charge region through which are made to pass the solid particles having crossed the filtration region 232 through a space charge formed by the ions issued from two ion injectors 252 and 254, operating by driving the ions with the assistance of aerosol particles, and penetrating into said chamber in the center of the lower and upper domes of said chamber 250 for projecting two charged fluxes in the direction of each other according to the vertical axis of the tank.

The finest dust particles which have escaped the filter region 232 are charged in chamber 250 and are filtered and electrostatically precipitated in region 234 of the granular bed. The granules of this region renew themselves progressively from piping 220 and, after having left region 234, are then re-used in the purely mechanical separation region 232.

The purified gas issued from outlet 230 of the electrostatic filter is admitted at the inlet of a gas turbine or possibly a piston engine after having been subjected to an intermediate chemical filtration step for removing the alkaline compounds or the vanadium.

In the example just presented, the distance between the injectors 252 and 254 is of about 1 meter, the diameter of the cylindrical chamber 250 being of 0.4 meter. The gas to be de-dusted is at a pressure of 12 bars and at a temperature of 900° C.

Figure 3:
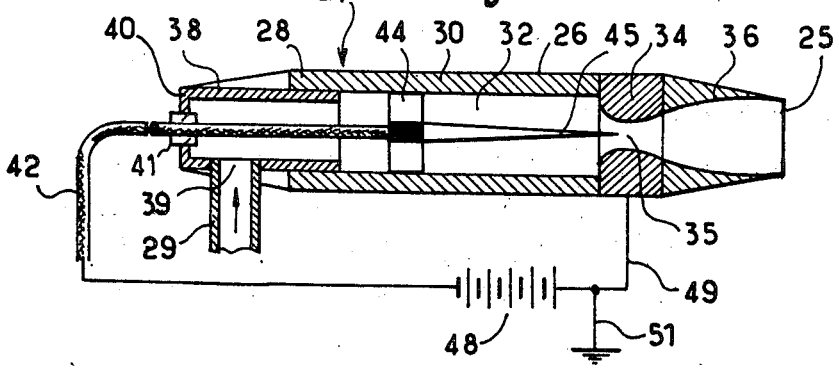
FIG. 3 is a longitudinal cross-sectional schematic view of an injector used for performing the invention.

The supersonic tuyère injectors 252 and 254 are fed with moist air under pressure. The neck of the metallic tuyère is connected to the mass; it has a diameter of 1 mm. The insulated metallic needle such as 45 in FIG. 3 is connected to a potential source of 20 to 25 kvolts. The current injected by each injector is of the order of 250 micro-amperes for a flow of air in duct 29 of 15 $m^3$/hour, measured under the normal pressure and temperature conditions, for a generating pressure of 27 bars.

For a flow of gas to be de-dusted of 3600 $m^3$/hour measured under the normal temperature and pressure conditions, which corresponds to the application of a force of the order of one megawatt at the inlet of a generator such as a gas turbine, with a dust content of 100 g/$m^3$, the first de-dusting step, comprising a passage in a cyclone and then the crossing of region 232 of the granular bed, provides a purification of 93% about, meaning that 7 g of particles remain to be removed at each second.

With the geometry indicated, the electric field produced in chamber 250 is of about 500 kvolts/m with a minimum ion density of the order of $10^{14}$ per $m^3$, representing a space charge sufficient for allowing particles having an average diameter of 3 microns and crossing the volume in consideration in 0.5 second, to acquire about 300 elementary charges, which is sufficient for their being collected by the polarized balls of the electrostatic filter with granular bed in the region 234. Under these conditions, a current driven by the charged particles towards the electrostatic filtration region 234 is of 12 micro-amperes. This current is weak in comparison with the total current injected by the injectors previously defined. The largest portion of this current is therefore eliminated by the metallic wall of the enclosure bounded by the metallic wall 214 which is connected to the mass.

As already stated, the particles transferred in the charge region 250 through the injectors 252 an 254 are positive ions. The value of the space charge resulting from this positive ion transfer is much less than the value of the space charge in the corona discharge inside the injectors themselves. Moreover, for avoiding local increases of the electric field produced inside region that create local unintentional discharges in some parts of this region, the inner surface of the metallic wall 214 bounding the space region 250 is polishd. Thus are eliminated the small points of said surface which could give rise to avalanches generating electrons, which, taking in account the high temperature of the gases, would risk a great reduction in the quantity of charges communicated to the dust particles and have a negative effect on the efficiency of the electrostatic precipitation.

When very hot gases are dealt with, for example at 900° C., as in the previous example, one can advantageously use an injection device slightly modified relative to that of FIG. 3, for making injector devices such as 252 and 254. Indeed, it can happen, notably with very high gas temperatures, that the fusion or sublimation of the microparticles which are charge carriers at the outlet of the injector occurs very rapidly and consequently in the immediate vicinity of the injector. The ions thus freed can then return to the injector and be captured by it, thereby reducing by the same quantity the space charge available for charging the particles transported by the gas to be de-dusted.

Two types of arrangements are provided for avoiding or limiting this capture. According to a first arrangement, the injector is brought to a positive potential relative to the walls of the metallic enclosure in which flow the gases to be de-dusted so as to create an electric field distribution having for effect to keep the ions produced away from the metallic masses of the injector.

According to another arrangement which can be used as such or in combination with the first, it is contemplated to cool down the micro-particles stream emitted by the injector. This cooling down can be obtained in particular by blowing a stream of cold gas, for example air, around the flux of microparticles injected into the enclosure. Under these conditions, the thermal transfers between the enclosure and the microparticles are delayed and the sublimation of the latter with liberation of the charges occurs only in a region of the enclosure which is sufficiently away from the injector for avoiding their capture by the latter.

An injection device 310 (FIG. 7) comprises an injector tube 312 bounding a chamber 314 inside which can flow the moist air stream under pressure in the direction of arrow 316 towards an opening at the end 318 of tube 312, the inner profile of which defines the tuyère. Coaxially to tube 312 is mounted a conductive electro-needle 320, the end 322 of which reaches the vicinity of the neck 324 of said tuyère. The needle 320 and the tube 312 are electrically connected to a high voltage source 328. Moreover, the tube 312 is kept at a relatively high positive electric potential, for example of 20 kilovolts, relative to the mass, by a voltage source 330. The injector tube 312 is mounted co-axially inside a metallic tube 332 the walls of which taper towards an opening 336 at its end 334 slightly downstream of end 318 of tube 312 in the direction of the gas flow inside the chamber 314. The tube 332 is mounted in an opening formed in the wall 340 of a metallic enclosure 342 of a hot gas electrostatic de-duster such for example as that shown in FIG. 5. The wall 340 is connected to mass. The tube 332 is polarised at a potential, which may be identical with or different from that of tube 312, by means of a voltage source 331. It is mounted in wall 340 by means of an insulating lead through 333.

Inside enclosure 342, the tube 332 is surrounded by a coil piping 344 through which can flow a non conductive cooling fluid. The pipes supplying the cooled fluid to the coil piping 344 are made out of a dielectric material to withstand the positive high voltage of source 331. Means not shown are provided for circulating an air stream towards enclosure 342, in the direction of arrow 346, in the annular space between tubes 312 and 332.

In operation, a flux 350 of charged microparticles injected in enclosures 342 is surrounded by a cold stream of air. substantially tubular and coming out from opening 336 of tube 332 which delays the heating up of said microparticles and their sublimation until they are away from injector tube 312. Moreover, said injector tube is brought to a high potential relative to walls 340, thereby creating a potential distribution inside enclosure 342 tending to draw the ions freed by sublimation from the microparticles away from the injector tube 312.

The fact that the blowing of cold air or of any other gas at the outlet 336 of tube 332 cools down the gases to be de-dusted is not a disadvantage in the applications to the feeding of hot gases to engines such as gas turbines from low combustion content fuel hearths. In fact, the temperatures of the gaseswhich can be obtained at the outlet of such hearths are much lower than the maximum temperature of about 900° C. which a gas turbine can support at its inlet in the present state of the technology. Therefore, it is enough to adjust the temperature of the gases coming out from the hearth as a function of the flow rate of the cooling gas of the injectors so as to obtain, after mixture, the required temperature at the inlet of the turbine.

Figure 7:
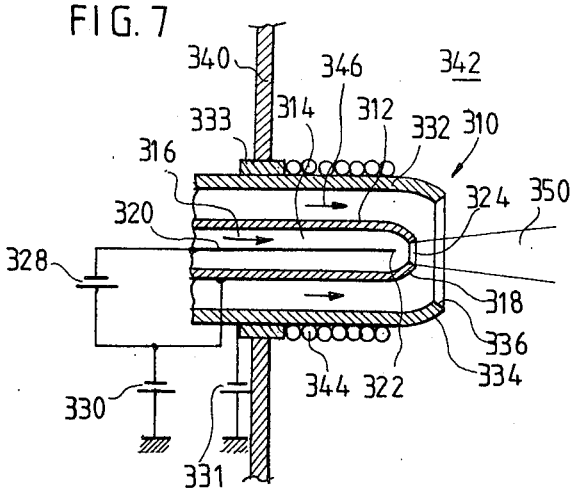
FIG. 7 shows schematically another embodiment of a ion injection device in an installation according to the invention.
Figure 8:
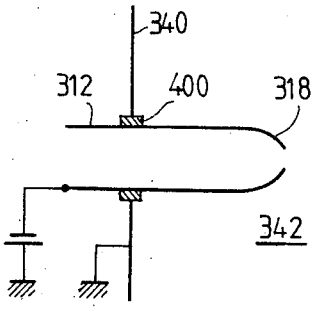
FIGS. 8, 9 and 10 show three alternative embodiments of the device of FIG. 7.

The embodiment of FIG. 7 can be the object of many alternatives. Thus, FIG. 8 shows a construction where the injector tube 312 is mounted directly on wall 340 of enclosure 342 with the assistance of an insulating lead-through 400. As in the case of FIG. 7, the body of tube 312 is brought to a high positive voltage relative to walls 340 which are connected to the mass. No blowing of cold air around the microparticles is provided.

Figure 9:
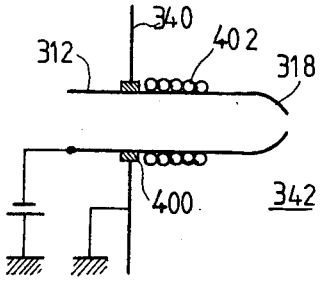

In FIG. 9, the outer surface of the injector tube 312, mounted as in the case of FIG. 8, is surrounded, inside enclosure 342, with a coil of piping 402 in which flows a cooling fluid.

The cooling fluid can be a dielectric fluid such as oil. The supplies of oil to the coil of piping 402 are provided by dielectric pipings having a length sufficient for keeping the high voltage applied to injector 312. One can also replace th oil by de-ionized water according to known techniques.

Figure 10:
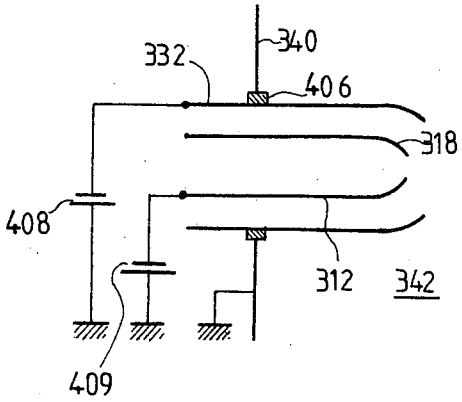

In the device of FIG. 10, the injector tube 312 is polarized by a voltage source 409. It is surrounded by the tube 332 in order to blow fresh air into enclosure 342 around the flux of injected microparticles. The tube 332 extends through wall 340 through an insulating lead-through 406. It is kept at a high positive potential by a continuous high voltage source 408.

Figure 11:
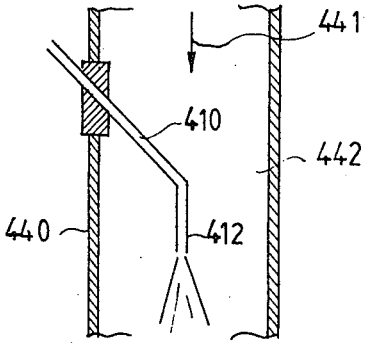
FIG. 11 shows an example of the use of the injector.

In an embodiment, FIG. 11, there is shown an injector device 412, such as described in the previous FIG. 7, at the end of a bent cane 410, in an enclosure 412 through which flows in the direction of arrow 441 a stream of hot gaseas to be de-dusted at the speed of 3 m/sec. Cane 410 extends through the wall 440 of the enclosure for feeding the injector 412 with moist air, the tube 332 with blowing air, and cooling water. The injector 412 is oriented so that the cold air stream blown aroundd the flux of projected microparticles is of the same direction and orientation as the gas to be de-dusted. The speed of the cold air stream is prferably selected at least equal to that of the gas, that is of 3 m/sec in this example.

The outlet diameter of tube 332 is of about 4 cm. The flow of the cold gas is of about 2% of the flow of the hot gas to be de-dusted, the temperature of the latter being slightly over 900° C. The region of action of the injector is then situated in a radius of about 15 cm from the end of the injector 412.

We claim:

1. A method for separating particles suspended in a gas, which comprises:

producing ions trapped by microscopic ice crystals by supersonic expansion of a moist gas stream in a supersonic nozzle including a corona discharge in a separate chamber;

injecting the ions trapped by the ice crystals into an enclosure from the nozzle causing the ice crystals to change their state in said enclosure freeing the trapped ions to create a space charge;

passing a gas containing suspended particles through the space charge thereby transferring a charge to the particles; and, collecting the charged particles by electrostatic deposition.

2. A method according to claim 1, wherein the moist gas is a gas the hygrometric degree of which, measured under the normal temperature and pressure conditions, is over 10%.

3. A method according to one of claims 1 or 2, wherein the flow of microscopic ice crystals injected into said enclosure is adjusted for maintaining the space charge at a predetermined value.

4. A method according to one of claims 1 or 2, wherein the gas containing suspended particles is formed of hot gases and wherein positive ions are trapped for forming a positive space charge on the path of said hot gas.

5. A method according ot one of claims 1 or 2, wherein the gas containing suspended particles is formed of air loaded with gluten particles and wherein the negative ions are trapped for forming a negative space charge in said air stream.

* * * * *

UNITED STATES PATENT AND TRADEMARK OFFICE

CERTIFICATE OF CORRECTION

PATENT NO. : 4,435,190

DATED : March 6, 1984

INVENTOR(S) : JOSEPH TAILLET et al

It is certified that error appears in the above-identified patent and that said Letters Patent is hereby corrected as shown below:

Foreign Application Priority Data should also include

--May 29, 1980 - France - 80 11945-- and

"March 14, 1981" for 81 09646 should be -- May 14, 1981--.

Column 5, line 34, "when" should be --which--;

Column 7, line 60, "comburent" should be --oxidant--;

Column 9, line 43, "an" should be --and--;

Column 9, line 48, after "region" insert --250--;

Column 11, line 27, "th" should be --the--;

Column 11, line 40, "gaseas" should be --gases--; and

Column 11, line 45, "aroundd" should be --around--.

Signed and Sealed this

*First* Day of *January 1985*

[SEAL]

*Attest:*

*Attesting Officer*

GERALD J. MOSSINGHOFF

*Commissioner of Patents and Trademarks*